US009468834B2

(12) United States Patent
Maisey

(10) Patent No.: US 9,468,834 B2
(45) Date of Patent: Oct. 18, 2016

(54) SWAGE AND FLARE JOINTS

(71) Applicant: Lifetime Products, Inc., Clearfield, UT (US)

(72) Inventor: Daniel G. Maisey, Riverdale, UT (US)

(73) Assignee: LIFETIME PRODUCTS, INC., Clearfield, UT (US)

( * ) Notice: Subject to any disclaimer, the term of this patent is extended or adjusted under 35 U.S.C. 154(b) by 81 days.

(21) Appl. No.: 14/469,216

(22) Filed: Aug. 26, 2014

(65) Prior Publication Data

US 2015/0165301 A1 Jun. 18, 2015

Related U.S. Application Data

(60) Provisional application No. 61/917,237, filed on Dec. 17, 2013.

(51) Int. Cl.
*A63B 63/08* (2006.01)
*A63B 71/02* (2006.01)

(52) U.S. Cl.
CPC ..... *A63B 71/023* (2013.01); *A63B 63/083* (2013.01); *A63B 2071/025* (2013.01); *A63B 2210/50* (2013.01); *A63B 2225/093* (2013.01); *Y10T 403/635* (2015.01)

(58) Field of Classification Search
USPC ..... 473/481, 513; 16/429; 279/43.3; 285/382, 397; 403/104, 334, 350; 464/162, 23; 470/10; 72/399; D8/382; D32/51
See application file for complete search history.

(56) References Cited

U.S. PATENT DOCUMENTS 2,265,109 A * 12/1941 Birkhofer ..... A63B 53/02 403/265
2,500,720 A 3/1950 Van Der Heem
3,072,988 A * 1/1963 Pennington ..... E04C 5/122 403/202
3,176,987 A * 4/1965 Johnston ..... A63B 53/007 403/292
3,865,498 A * 2/1975 Okuto ..... E04H 12/08 403/292
3,936,206 A * 2/1976 Meisberger ..... E04H 12/08 403/334
4,095,825 A * 6/1978 Butler ..... B29C 57/00 156/294
5,522,101 A * 6/1996 Yeh ..... A47C 19/005 403/334
5,839,714 A 11/1998 Fitzsimmons et al.
7,946,936 B2 5/2011 Stanford
2015/0165301 A1* 6/2015 Maisey ..... A63B 71/023 473/481

FOREIGN PATENT DOCUMENTS

WO PCT/US14/53505 12/2014

OTHER PUBLICATIONS

Rob Dean, Selecting a Tube End Forming Method, TJP—The Tube Pipe Journal, Sep. 2006, http://www.thefabricator.com/article/tubepipefabrication/selecting-a-tube-end-forming-method.

* cited by examiner

*Primary Examiner* — Gene Kim
*Assistant Examiner* — M Chambers
(74) *Attorney, Agent, or Firm* — Workman Nydegger

(57) ABSTRACT

In one example, an apparatus, such as a support pole of a basketball system for example, is provided that includes an elongate member with an unswaged portion that has a perimeter length, and also includes a swaged portion that is attached to the unswaged portion and has a perimeter whose effective length is shorter than the perimeter length of the unswaged portion. The swaged portion includes walls that cooperate to define part of the perimeter of the swaged portion, where two of the walls are straight and terminate at a common point, and the swaged portion further includes a local deformation defined in one of the walls. As well, a tapered portion is provided that is configured to receive the swaged portion such that when the swaged portion is received in the tapered portion, the wall of the swaged portion that includes the local deformation substantially contacts the tapered portion.

12 Claims, 12 Drawing Sheets

SWAGE AND FLARE JOINTS

RELATED APPLICATIONS

This application hereby claims priority to U.S. Provisional Patent Application, Ser. No. 61/917,237, entitled SWAGE AND FLARE JOINTS, and filed on Dec. 17, 2013. The aforementioned application is incorporated herein in its entirety by this reference.

BACKGROUND

Swage and flare joints enable two tubes having about the same overall perimeter size to be fitted together, one inside the other. In general, this involves flaring a first tube so as to increase the inside perimeter of the first tube, and swaging the second tube so as to decrease the outside perimeter of the second tube. In this way, the second tube can be received within the first tube.

The joint thus produced however may prove problematic insofar as there may be very limited contact between the swaged tube and the flared tube. This result can occur when the walls of a square swaged tube are deformed along their a substantial portion of their length such that the only contact between the swaged tube and a mating flared tube occurs at the four corners of the swaged tube. Such point contact may permit movement between the swaged tube and the flared tube. As well, point contact between the swaged tube and the flared tube, may contribute to instability of the assembled joint that could result in wobbling of a structure supported by the joint, and/or may result in a relatively weaker joint that could fail in some loading situations.

In view of the foregoing, it would be useful to provide swage and flare joints that implement substantial contact between the swaged portion and the flared portion of the joint.

BRIEF SUMMARY OF SOME ASPECTS OF THE DISCLOSURE

It should be noted that the embodiments disclosed herein do not constitute an exhaustive summary of all possible embodiments, nor does this brief summary constitute an exhaustive list of all aspects of any particular embodiment(s). Rather, this brief summary simply presents selected aspects of some example embodiments. It should be noted that nothing herein should be construed as constituting an essential or indispensable element of any invention or embodiment. Rather, various aspects of the disclosed embodiments may be combined in a variety of ways so as to define yet further embodiments. Such further embodiments are considered as being within the scope of this disclosure.

As well, none of the embodiments embraced within the scope of this disclosure should be construed as resolving, or being limited to the resolution of, any particular problem(s). Nor should such embodiments be construed to implement, or be limited to implementation of, any particular technical effect(s) or solution(s).

The present disclosure is generally concerned with joints that may be used to releasably, or permanently, connect a pair of mating elements, where the mating elements are configured such that one mating element can be partly received within the other mating element. More specifically, embodiments of the invention include swage and flare joints, as well as joints that include a swaged portion that mates with an unflared portion.

Embodiments within the scope of this disclosure may include any one or more of the following elements, and features of elements, in any combination: a mating element having a swaged portion and/or a flared portion; a tubular, or substantially solid, mating element having a swaged portion and/or a flared portion; a mating element having a swaged end and/or a flared end; a tubular, or substantially solid, mating element having a swaged end and/or a flared end; a swaged portion with substantially straight walls; a swaged portion with substantially straight walls, one or more of which includes a deformation; a swaged portion having one or more walls configured for substantial contact with a mating flared portion; a swaged portion whose walls are configured for substantial contact with a mating flared portion; a swaged portion configured to be received, permanently or removably, within a flared portion; a swaged portion configured to contact a mating flared portion at the corners of a perimeter of the swaged portion and at one or more other locations of the perimeter of the swaged portion; a swaged portion with a substantially square or rectangular cross-section; a swaged portion with a cross-section whose shape is other than substantially square; a swaged portion with a substantially circular cross-section; a swaged portion having three or more walls; a flared portion whose walls are configured for substantial contact with a mating swaged portion; a flare configured to mate, either permanently or releasably, with any of the aforementioned swages such that substantial contact between the flare and swage is achieved; any of the aforementioned swaged portions including one or more walls or surfaces that include a respective local deformity; any combination of any one or more of the aforementioned swages and flares; and, a basketball system including any combination of any one or more of the aforementioned swages and flares.

Following is a non-exclusive list of embodiments within the scope of the invention. It should be understood that aspects of the various embodiments may be combined in other ways to define still further embodiments.

In a first example embodiment, a first mating element has a swaged portion whose outer surface is configured to make substantial contact with the inner surface of a flared second mating element.

In a second example embodiment, a first mating element has a swaged portion with a plurality of walls, each of which is configured to make substantial contact with a corresponding wall of a flared second mating element.

In a third example embodiment, a first tubular mating element has a swaged portion with a plurality of walls, each of which is configured to make substantial contact with a corresponding wall of a second tubular mating element having a flared portion.

In a fourth example embodiment, a first tubular mating element has a swaged portion with a plurality of substantially straight walls, each of which is configured to make substantial contact with a corresponding wall of a second tubular mating element having a flared portion.

In a fifth example embodiment, a first tubular mating element has a swaged portion with a plurality of walls, each of which has an outer surface configured to make substantial contact with an inner surface of a corresponding wall of a second tubular mating element having a flared portion.

In a sixth example embodiment, a first tubular mating element has a swaged portion with four walls that collectively define a generally square or rectangular cross section shape of the first tubular mating element, each of the four walls having an outer surface configured to make substantial contact with an inner surface of a corresponding wall of a second tubular mating element having a flared portion.

In a seventh example embodiment, a first mating element has a swaged portion with a plurality of walls, each of which is configured to make substantial contact with a corresponding wall of a flared second mating element, and one or more of the walls of the first mating element includes a local deformation.

In an eighth example embodiment, a first tubular mating element has a swaged portion with a plurality of walls, each of which is configured to make substantial contact with a corresponding wall of a second tubular mating element having a flared portion, and one or more of the walls of the swaged portion includes a local deformation.

In a ninth example embodiment, a first tubular mating element has a swaged portion with a plurality of substantially straight walls, each of which is configured to make substantial contact with a corresponding wall of a second tubular mating element having a flared portion, and one or more of the walls of the first tubular mating element includes a local deformation.

In a tenth example embodiment, a first tubular mating element has a swaged portion with a plurality of walls, each of which has an outer surface configured to make substantial contact with an inner surface of a corresponding wall of a second tubular mating element having a flared portion, and one or more of the walls of the first tubular mating element includes a local deformation.

In an eleventh example embodiment, a first tubular mating element has a swaged portion with four walls that collectively define a generally square or rectangular cross section shape of the first tubular mating element, each of the four walls having an outer surface configured to make substantial contact with an inner surface of a corresponding wall of a second tubular mating element having a flared portion, and one or more of the walls of the first tubular mating element includes a local deformation.

In variations of a twelfth example embodiment, a basketball system includes a support pole, and/or other structure(s), that incorporates any of the preceding embodiments.

As well, this disclosure embraces the embodiments disclosed herein both in respective assembled forms, and in respective kit forms. When in the form of a kit, the embodiment may be partly or completely disassembled. For example, an element including a swaged portion and an element including a mating flared portion may be separate pieces in such a kit.

BRIEF DESCRIPTION OF THE DRAWINGS

The appended drawings contain figures of some example embodiments to further clarify various aspects of the present disclosure. It will be appreciated that these drawings depict only some embodiments of the disclosure and are not intended to limit its scope in any way. The disclosure will be described and explained with additional specificity and detail through the use of the accompanying drawings in which.

DETAILED DESCRIPTION OF SOME EXAMPLE EMBODIMENTS

Figure 1:
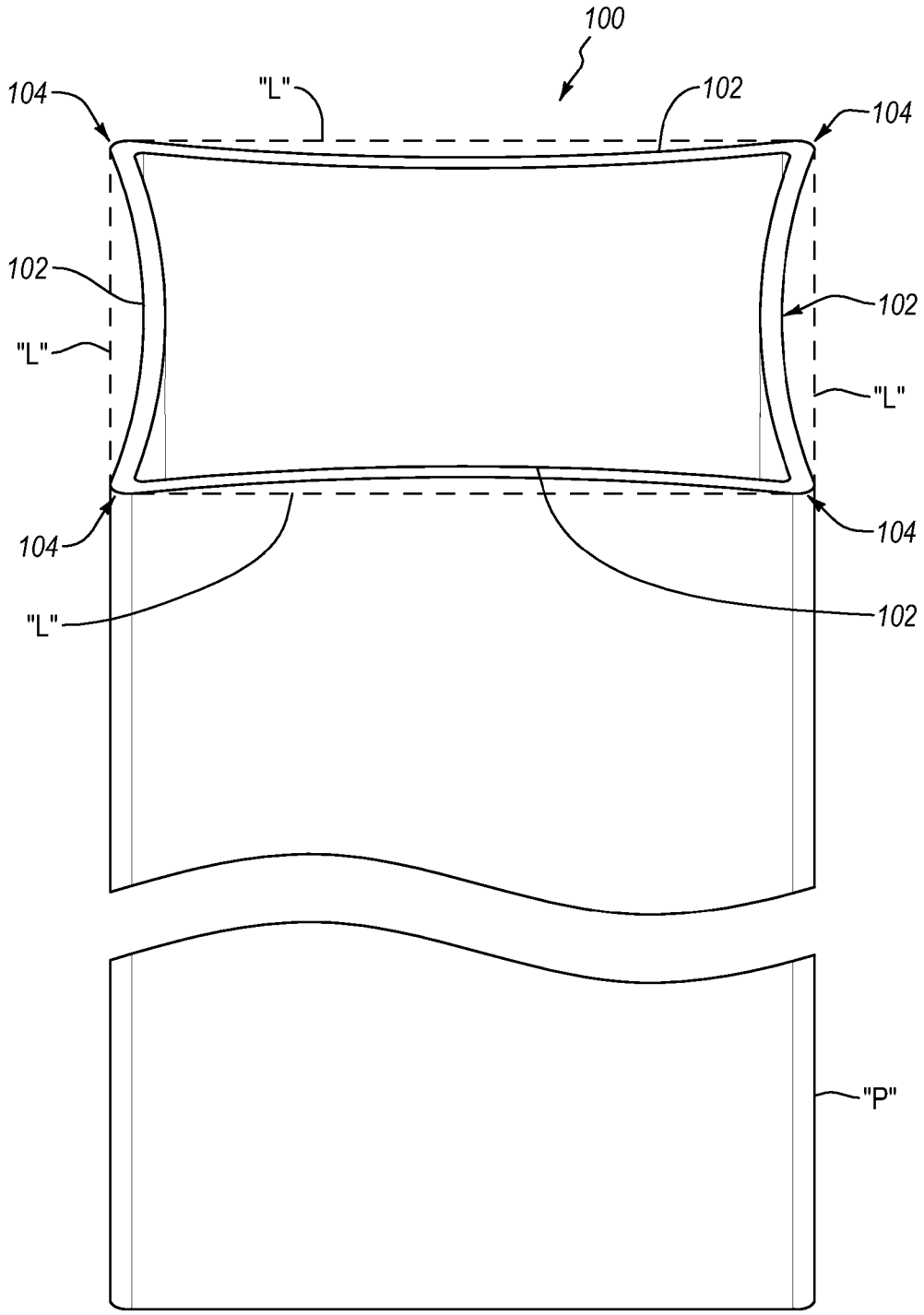
FIG. 1 is a perspective view of an example of an embodiment of a structure having a swaged portion.

The present disclosure is generally concerned with joints that may be used to releasably, or permanently, connect a pair of mating elements, where embodiments of the mating elements are configured such that one mating element can be partly received within the other mating element. More specifically, embodiments of the invention include joints that including a swaged portion and a flared portion that are configured to mate, either releasably or permanently, with each other. The swaged portion may include one or more local deformities in one or more surfaces that interface with the flared portion. Embodiments of the invention also include a die, or dies, configured to enable production of the swaged portions and flared portions disclosed herein.

A. General Aspects of Some Example Embodiments

Embodiments of the invention can be employed in a wide variety of applications and, accordingly, the scope of the invention is not limited to the example applications and structures disclosed herein. Rather, such applications, which include outdoor equipment such as playground equipment and basketball systems, are discussed herein for the purpose of illustration, and not by way of limitation. In general, embodiments of the invention can be employed in any application or environment where it is desired to permanently, or releasably, attach a pair of elements together.

With reference to one of the examples noted above, elements of outdoor equipment, such as playground equipment and basketball systems, may be constructed with a variety of components and materials including, but not limited to, plastic (including injection-molded, blow-molded, roto-molded, and twin sheet plastic structures and elements) including polycarbonates, composites, metals, and combinations of any of the foregoing.

Suitable metals may include steel, aluminum, and aluminum alloys, although the skilled person will understand that a variety of other metals, and combinations of metals, may be employed as well and the scope of the invention is not limited to the foregoing examples. Where metal is employed in the construction of a component, the metal elements may take one or more forms including, but not limited to, square tube, rectangular tube, oval tube, polygonal tube, triangular tube, round tube, pipe, and solid, rather than tubular, forms of any of the foregoing. Any of these tubes, pipes or solid pieces may include radiused corners where walls intersect with each other, so as to reduce or eliminate stress concentrations. Metal is but one example of a plastically deformable material that can be used in the constructions of at least some embodiments of the invention.

Depending upon the material(s) employed in the construction of outdoor equipment, a variety of methods and components may be used to connect, releasably or permanently, various elements of the outdoor equipment. For example, the various metal elements of outdoor equipment or components within the scope of this disclosure may be attached to each other by any one or more of processes such as welding or brazing, mechanically by way of fasteners such as bolts, screws, pins, and rivets, for example, by clamps, by mechanical structures such as swages and flares, and by any combination of one or more of the foregoing.

Some, none, or all portions of one or more of the outdoor equipment and its components may be coated with paint or other materials. Surface treatments and textures may also be applied to portions of the outdoor equipment. At least some of such materials may serve to help prevent, or reduce, rust and corrosion.

B. Structural Aspects of a Comparative Example

Figure 2:
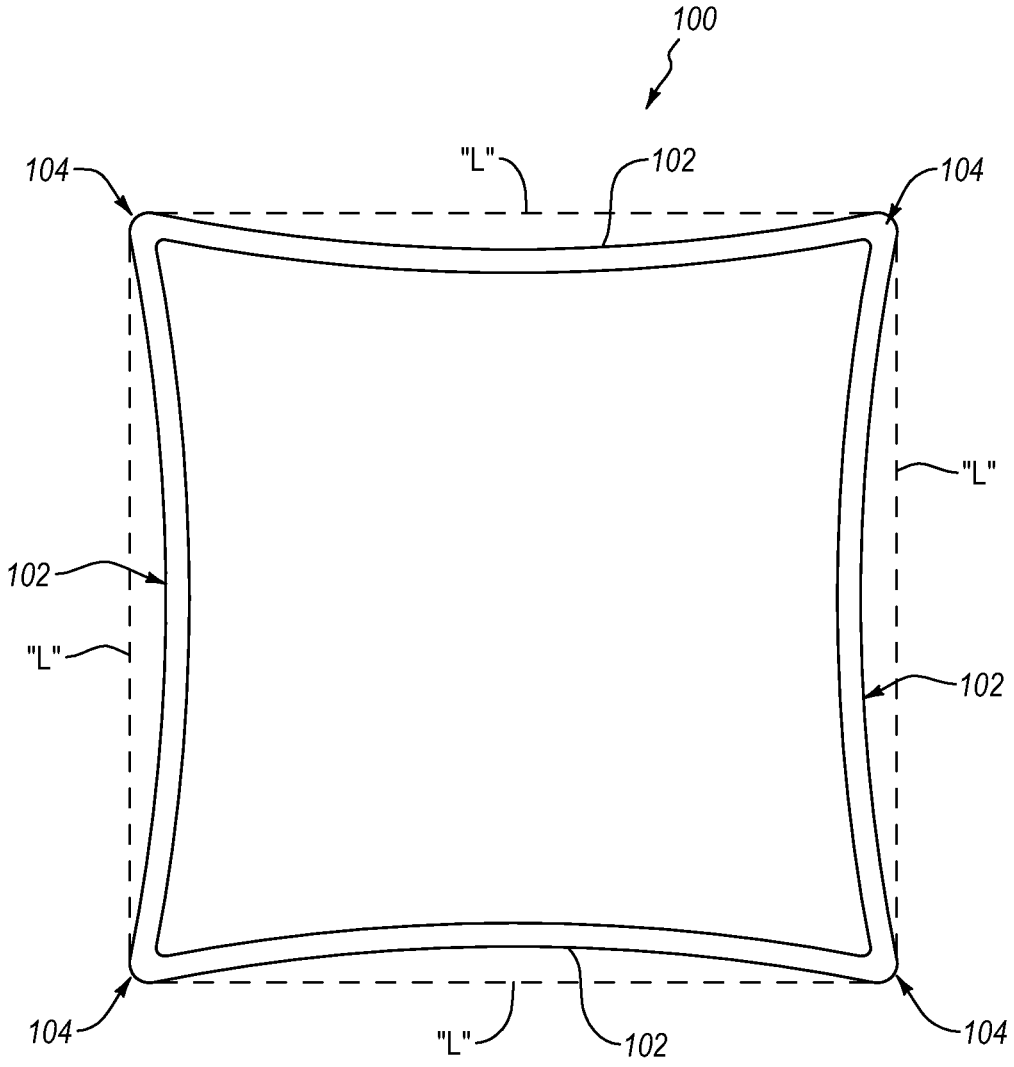
FIG. 2 is a top view of the example of FIG. 1.
Figure 3:
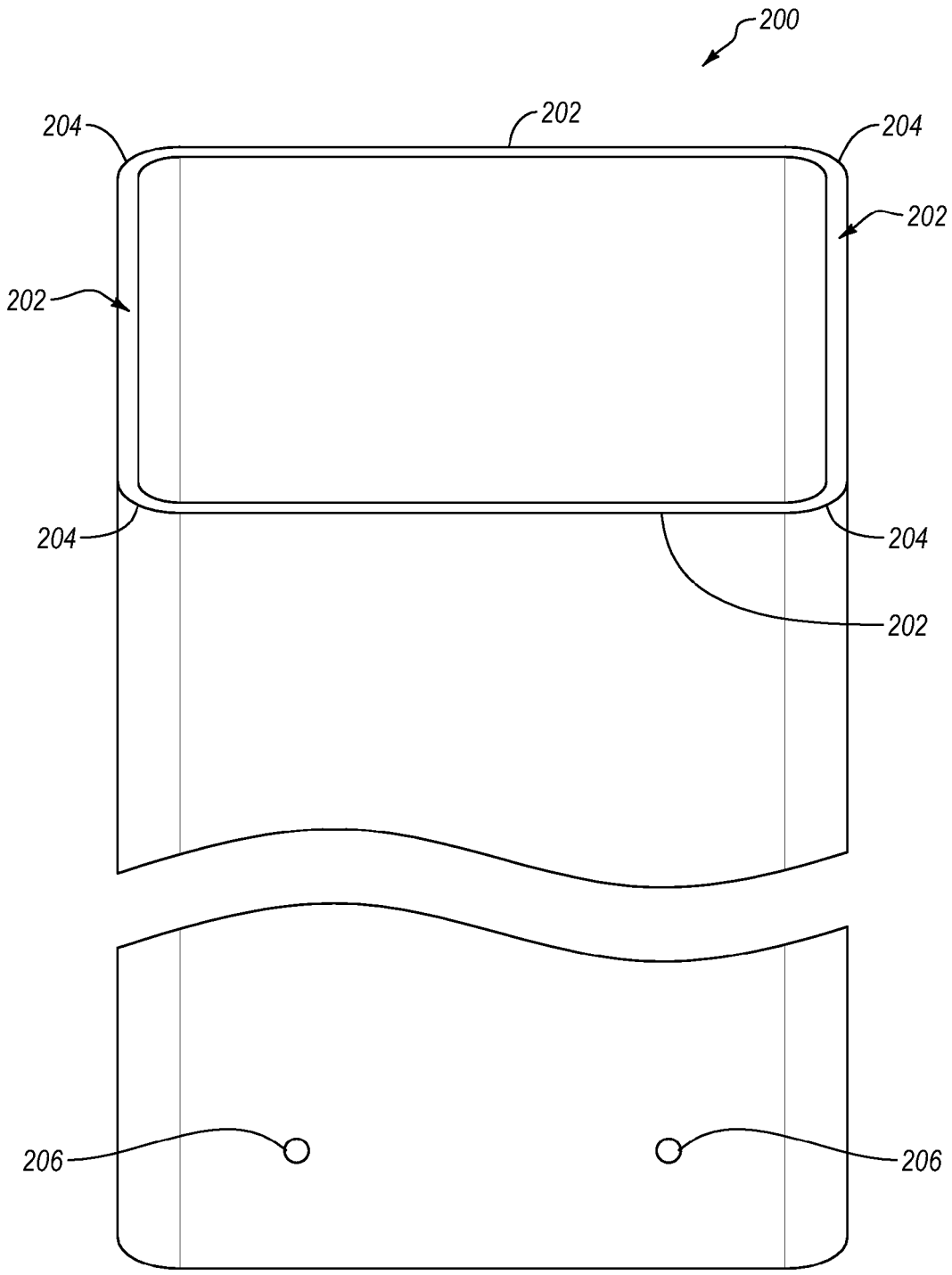
FIG. 3 is a perspective view of an embodiment of a structure including a flared portion suitable for mating with the structures of FIGS. 1 and 2.
Figure 4:
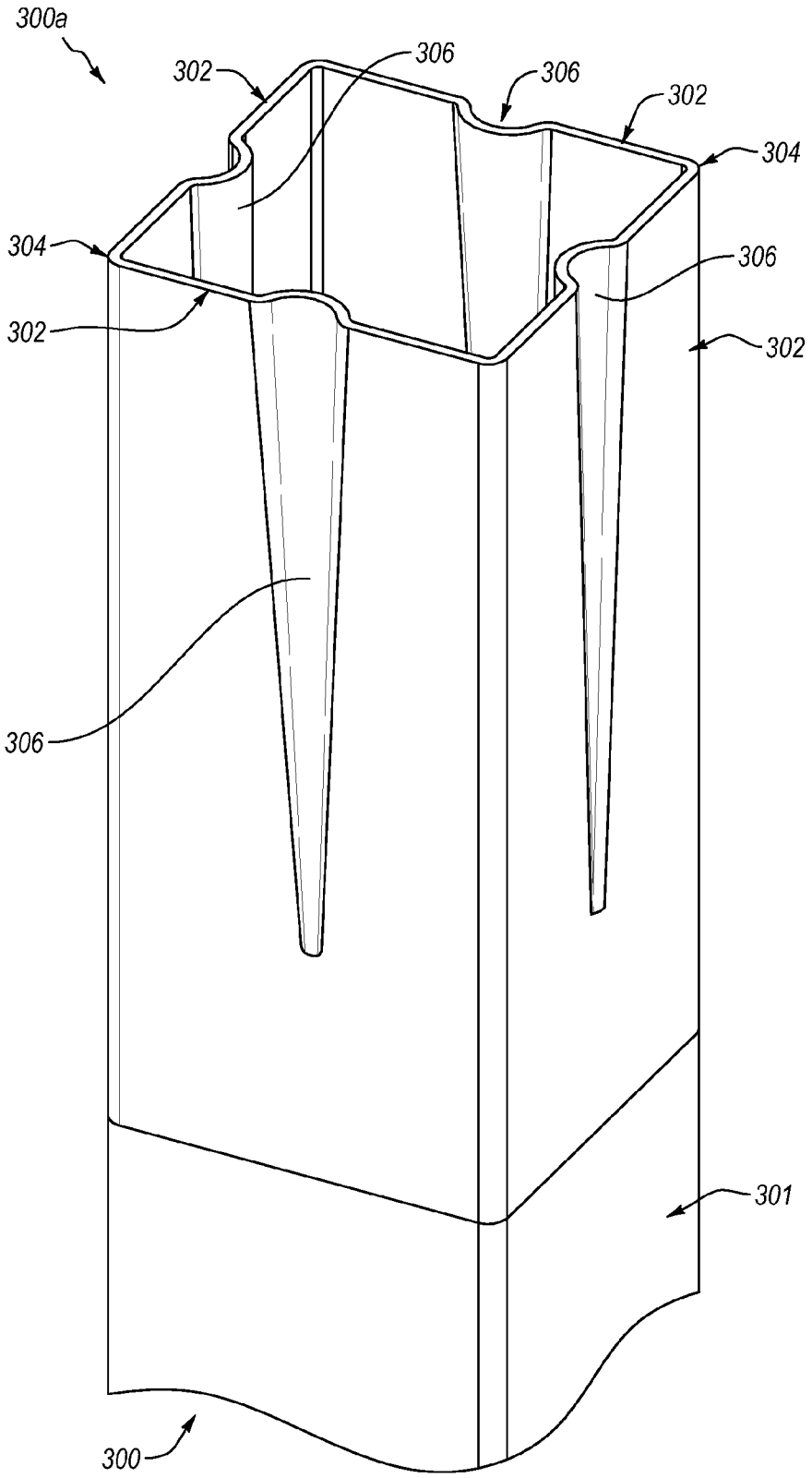
FIG. 4 is a perspective view of an embodiment of an alternative structure having a swaged portion.
Figure 5:
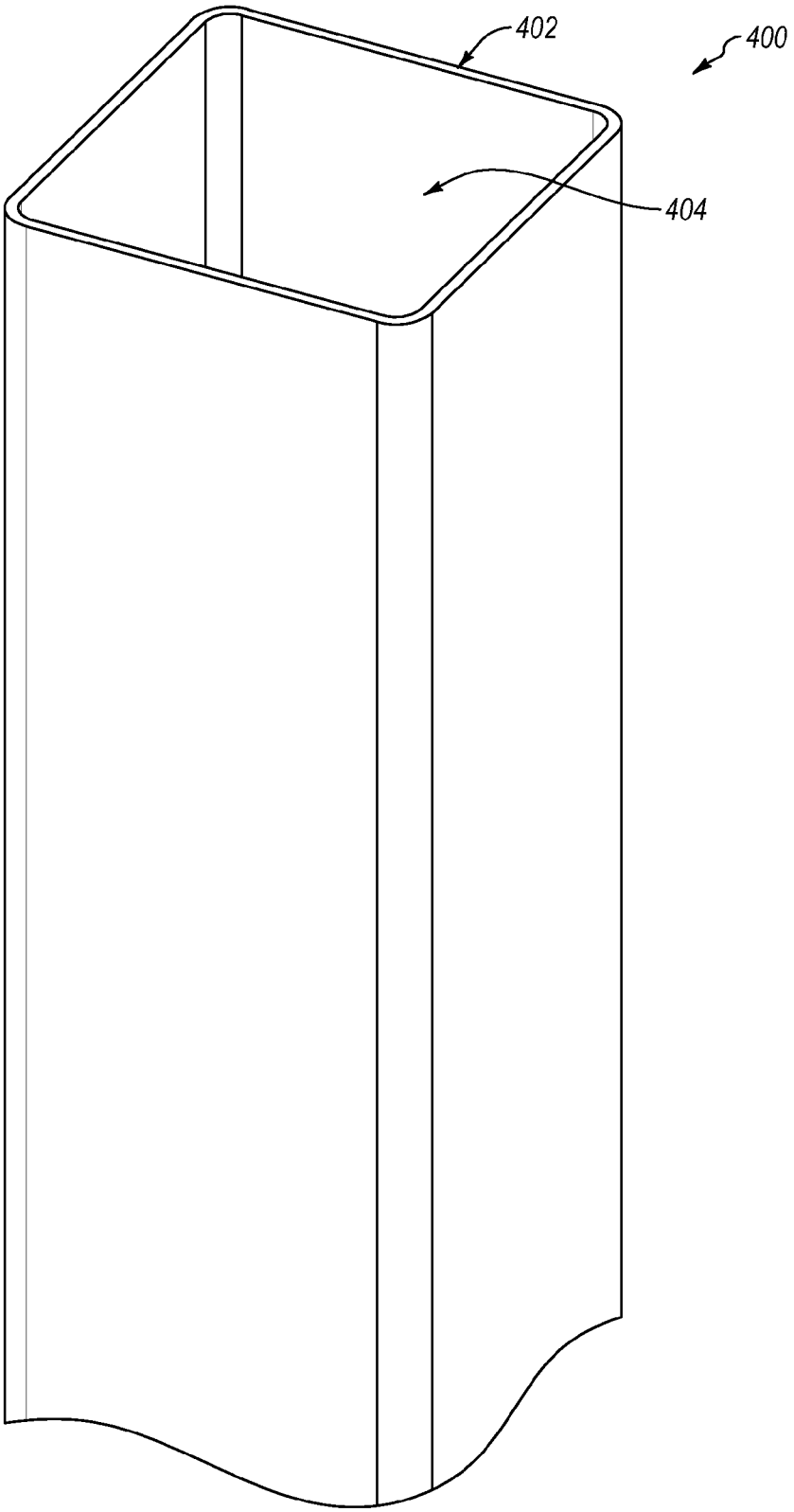
FIG. 5 is a perspective view of an embodiment of a structure including a flared portion suitable for mating with the structure of FIG. 4.
Figure 6:
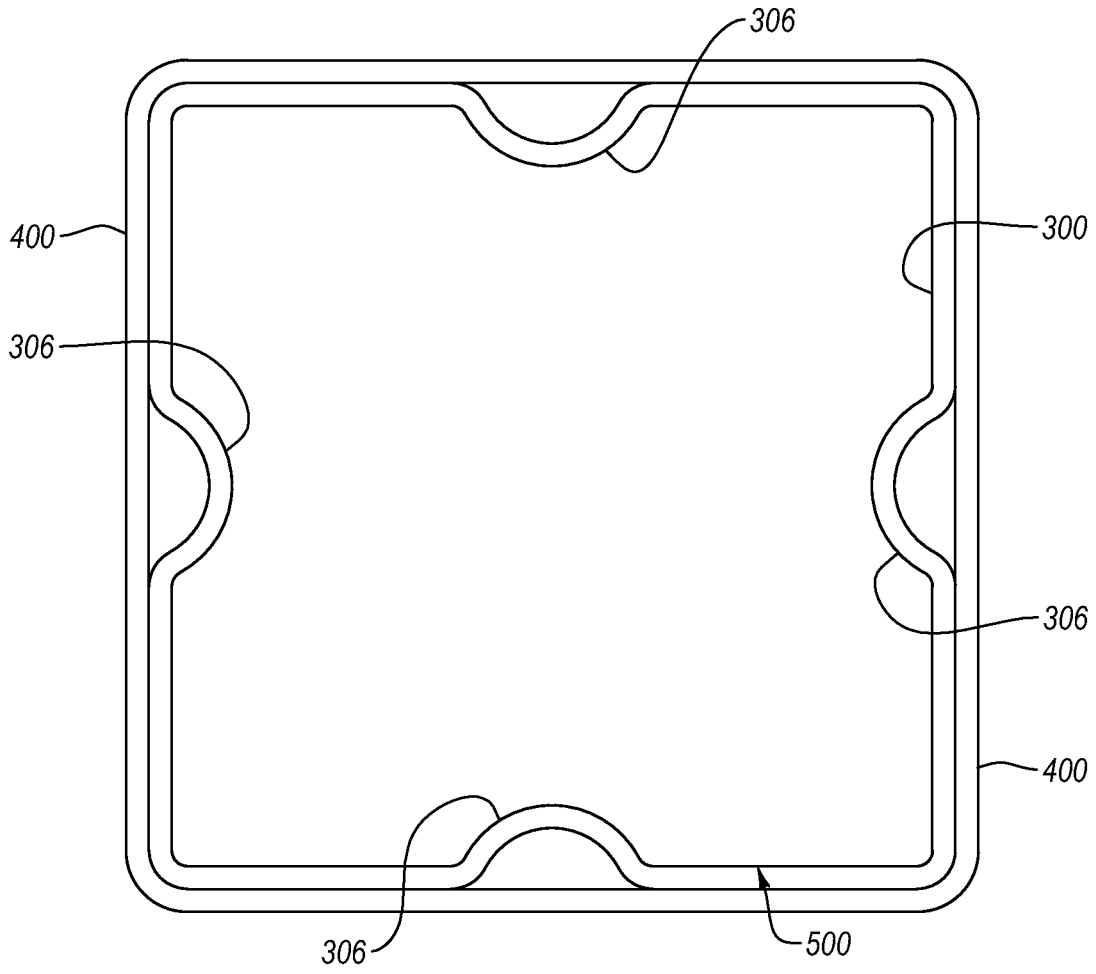
FIG. 6 is a top cross-sectional view of the example structures of FIGS. 4 and 5 in a mated arrangement.

Directing attention first to FIGS. 1-3, details are provided concerning some structures that are set forth herein for the purposes of comparison with the example embodiments of FIGS. 4-6.

As indicated in FIGS. 1-2, a swaged portion 100 in the form of a square tube is disclosed that has a generally square cross-sectional shape. The swaged portion 100 includes four walls 102 that intersect so as to define four corners 104. The swaged portion 100 has been swaged so that the effective length of the perimeter at the terminal end, defined as the sum of the lengths of the four segments "L," is relatively shorter than the actual length of the perimeter, defined as the sum of the lengths of the deformed walls. As well, the effective length of the perimeter at the terminal end is shorter than the overall length of the perimeter at a location "P" where no swaging has been performed.

This configuration has been achieved by a swaging process that causes a deformation of each of the walls 102. In particular, each wall 102 deflects inwardly toward the interior of the swaged portion 100. As a result of the deflection of each of the walls 102, the overall length of the perimeter of the terminal end of the swaged portion 100 is relatively shorter than it would be if the walls 102 were not so deflected, although the basic overall shape of the cross-section of the swaged portion 100 is generally retained. As can be seen in FIGS. 1 and 2, the deflection extends over substantially the entire length of each wall 102, that is, the entire wall 102 is deflected between successive corners 104. Thus deflected, the wall 102 takes on a curved, rather than straight, configuration.

While the configuration of the swaged portion 100 is adequate to ensure that the swaged portion 100 can mate with the flared portion 200 illustrated in FIG. 3, that configuration may not be well suited for some applications. For example, because the walls 102 are each deflected inwardly, the deflected portions may not contact the corresponding walls 202 of the flared portion 200. As a result, the primary, or only, contact between the swaged portion 100 and the flared portion 200 occurs where the corners 104 of the swaged portion 100 contact the corners 204 of the flared portion 200.

Such minimal contact between the swaged portion 100 and the flared portion 200 may be problematic insofar as it may permit movement between the swaged portion 100 and flared portion 200, may contribute to instability of the assembled joint that could result in wobbling of a structure supported by the joint, and/or may result in a relatively weaker joint that could fail in some loading situations. Concerns such as these could result in a need for supplemental support of the joint such as by way of fasteners (not shown) positioned in holes 206. However, the use of fasteners can complicate the assembly of the joint, and may make the joint harder to break down, should there be a need to do so.

C. Structural Aspects of Some Example Embodiments

In light of considerations such as those noted above, it would be useful, in at least some instances, to construct a swage and flare joint that provides for relatively more substantial contact between the swaged portion and the flared portion of the joint. Accordingly, attention is directed now to FIGS. 4-6 which disclose aspects of embodiments of a swage and flare joint that include a swaged portion 300 and a flared portion 400.

As used herein, swaging and swaging processes include forging processes in which one or more dimensions of an item are altered. Swaging can be performed as a cold working process where an item is forced into a confining die to reduce one or more dimensions of the item, such as the length of the perimeter of the item for example.

Swaging an item with one or more dies can also be performed as a hot working process. The use of one or more dies in this way is sometimes referred to as tube swaging. Another type of swaging process, sometimes referred to as rotary swaging or radial forging, involves the use of multiple dies to hammer a workpiece into a desired shape, and reducing one or more dimensions of the workpiece in the process. Rotary swaging may be particularly useful for shaping solid workpieces.

It should be noted that any die or group of dies configured to enable the formation of swaged portions such as are disclosed herein are considered to be within the scope of the invention.

D. Example Swaged Portions

With particular reference to FIG. 4, the swaged portion 300 may comprise a tubular form as shown, or may be a solid structure, either of which may be configured to be received in a corresponding tapered portion of a joint. In the illustrated example, the swaged portion 300 is in the form of tube having a cross-section whose shape is substantially square, although tubes or solid structures of other shapes can alternatively be employed. In at least some embodiments, a single piece of material may include multiple swaged portions, which may, or may not, be the same size and/or shape as each other. For example, a piece of tube or solid stock may have a first swaged portion at one end, and a second swaged portion at the other end.

In the example of FIG. 4, the swaged portion 300 has been swaged so that the overall length of the perimeter at the terminal end 300A is relatively smaller than the overall length of the perimeter at a point 301 located some distance away from the terminal end 300A. Thus, the swaged portion 300 in this example tapers from point 301 to the terminal end 300A of the swaged portion 300, so that the cross-section area of the swaged portion at point 301 is relatively greater than the cross-section area of the swaged portion at the terminal end 300A. This configuration can be achieved by swaging processes and swaging dies such as those disclosed herein. In general, the perimeter and configuration of the swaged portion 300 is such that when the swaged portion 300 is fully received in a corresponding flared portion, such as flared portion 400 for example, one or more of the walls 302 are in substantial contact with corresponding walls of the flared portion.

As indicated in FIG. 4, the walls 302 of the swaged portion 300 are substantially straight and connect with each other at a plurality of corners 304. In some instances, it may be useful to introduce one or more local deformations 306 into one, two, three, or all, of the walls 302 so as to enable the desired shortening of the effective lengths of one or more of the walls 302, while generally maintaining the relatively straight, or otherwise undeformed, configuration of the walls 302.

Thus, the walls 302 differ from the walls 202 indicated in FIGS. 1-3, at least in that the walls 302 have only a local deformation 306 and are not deformed along all, or a substantial part of, their length, as is the case with the walls 202. The local deformation(s) may be such that, notwithstanding their presence, the overall shape of the cross-section of the swaged portion 300 is generally retained.

In the example of FIG. 4, the local deformations 306 each have a curved cross-section shape which could be generally circular, generally elliptical, or any other curved shape, or a portion of any of the foregoing. The local deformations 306 need not be curved however and may alternatively be pointed, or have any other suitable configuration. However, local deformations with curved cross-section shapes may help to reduce, or eliminate, stress concentrations that may otherwise occur with the use of straight or pointed shapes.

As well, and apparent from FIG. 4 for example, any one or more attributes of a local deformation 306, such as the width and/or depth, may vary along a portion of the length of the swaged portion. In the particular example of FIG. 4, both the width and the depth of the local deformation 306 varies along the swaged portion such that the local deformation 306 is relatively wider and deeper at the terminal end of the swaged portion than at a location distal from the terminal end. In other embodiments, one or more attributes of the local deformation 306, such as the width and/or depth for example, may be substantially consistent over all of, or a substantial portion of, the length of the local deformation 306.

As well, the local deformations 306 each have substantially the same width and depth as each other, although that is not required. More particularly, and with continued reference to the example of FIG. 4, the example local deformations 306 each taper from a maximum width and depth at the terminal end of the swaged portion 300 to a location where the taper in both width and depth disappears, or at least substantially disappears.

It will be appreciated that the configuration of the local deformations 306 set forth in FIG. 4 is presented solely by way of example, and is not intended to limit the scope of the invention in any way. In general, any local deformation(s) that enable a substantial portion of one or more walls of a swaged portion including one or more such local deformations to make contact with a corresponding wall of a tapered portion can be employed. Thus, such walls may be substantially undeformed except for their inclusion of one or more local deformations.

It should be noted that local deformations can be employed in walls that are not straight, or not substantially straight. For example, one or more local deformations could be employed in a swaged portion, such as a substantially circular swaged portion for example, that included one or more curved walls. One example of a circular swaged portion includes one, or two, pairs of opposing local deformations.

Moreover, in some embodiments of a swaged portion that include multiple walls, fewer than all of the walls, such as only one, two, or three, walls may include a local deformation. Further, where multiple local deformations are employed in an embodiment, those local deformations may all have substantially the same configuration. In one or more alternative embodiments, at least one local deformation has a configuration that is substantially different from the configuration of another local deformation.

As well, any one or more of attributes such as the size, number, shape, location, and orientation of the local deformations can be varied. Two or more local deformations in a single swaged portion can be substantially the same as, or differ from, each other in any grouping of one or more of the aforementioned attributes.

In some example embodiments, one or more walls of a swaged portion include multiple local deformations. With regard to the aforementioned attributes, the multiple local deformations in such examples may be substantially the same as each other in one or more of those attributes, or may be different from each other in one or more of those attributes.

With regard to the example configuration of FIGS. 4-6, such configurations can be formed using a die. In one example embodiment, the die is substantially hollow and has an interior configuration that is generally a mirror image of the exterior configuration of the swaged portion 300. A square tube can then be forced into the die to produce the configuration shown in the example of FIG. 4.

E. Example Flared Portions

With reference now to FIG. 5, and continued reference to FIG. 4, a flared portion, one example of which is denoted at 400, is disclosed. The flared portion 400, like some embodiments of the swaged portion 300 may comprise tube. The flared portion 400 is configured with a plurality of walls 402 that define an interior 404 whose shape is the same general shape as the exterior of the swaged portion 300, with the exception of the local deformations 306, and a slightly larger size than the swaged portion 300. The slightly larger size of the interior 404 enables the swaged portion 300 to be securely, but removably, received within the flared portion 400.

In some embodiments, the swaged portion 300 may be permanently connected to the flared portion 400 once received therein. Suitable processes for permanently connecting the flared portion 400 and swaged portion 300 are disclosed elsewhere herein, and include welding, soldering, brazing, or the use of fasteners. Combinations of these processes may also be employed.

F. Example Joints and Applications

Turning now to FIG. 6, a joint 500 configuration is indicated where the swaged portion 300 is received within the flared portion 400. As evident from FIG. 6, there is substantial contact between the swaged portion 300 and the flared portion 400, except at the locations of the local deformations 306. Such substantial contact may contribute to stability of the assembled joint 500 that could reduce or prevent wobbling of a structure supported by the joint 500, and/or may result in a relatively stronger joint 500 that is better able to handle a variety of loading situations.

As noted elsewhere herein, the joint 500 could be employed in a wide variety of different applications, one example of which is a support pole for a basketball system. In one example of such an embodiment, the flared portion 400 and swaged portion 300 would each comprise an element of a respective piece of a support pole. The flared portion 400 could be implemented in either the upper or lower piece of such support pole, and the swaged portion 300 could likewise be implemented in either the upper or lower piece of such a support pole.

Figure 7A:
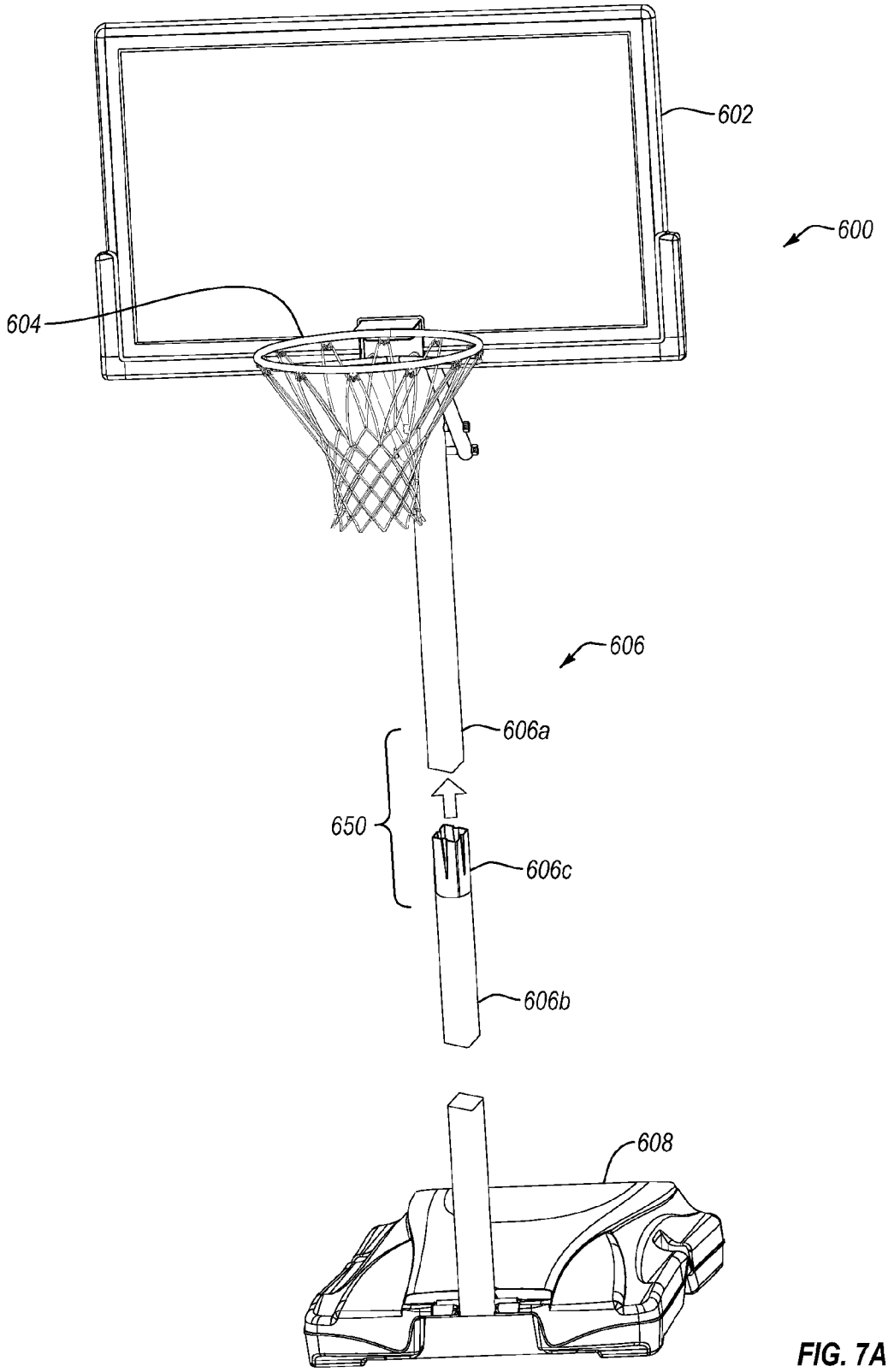
FIGS. 7*a* and 7*b* are views of an example basketball system with a joint that includes a flared portion and a swaged portion.
Figure 7B:
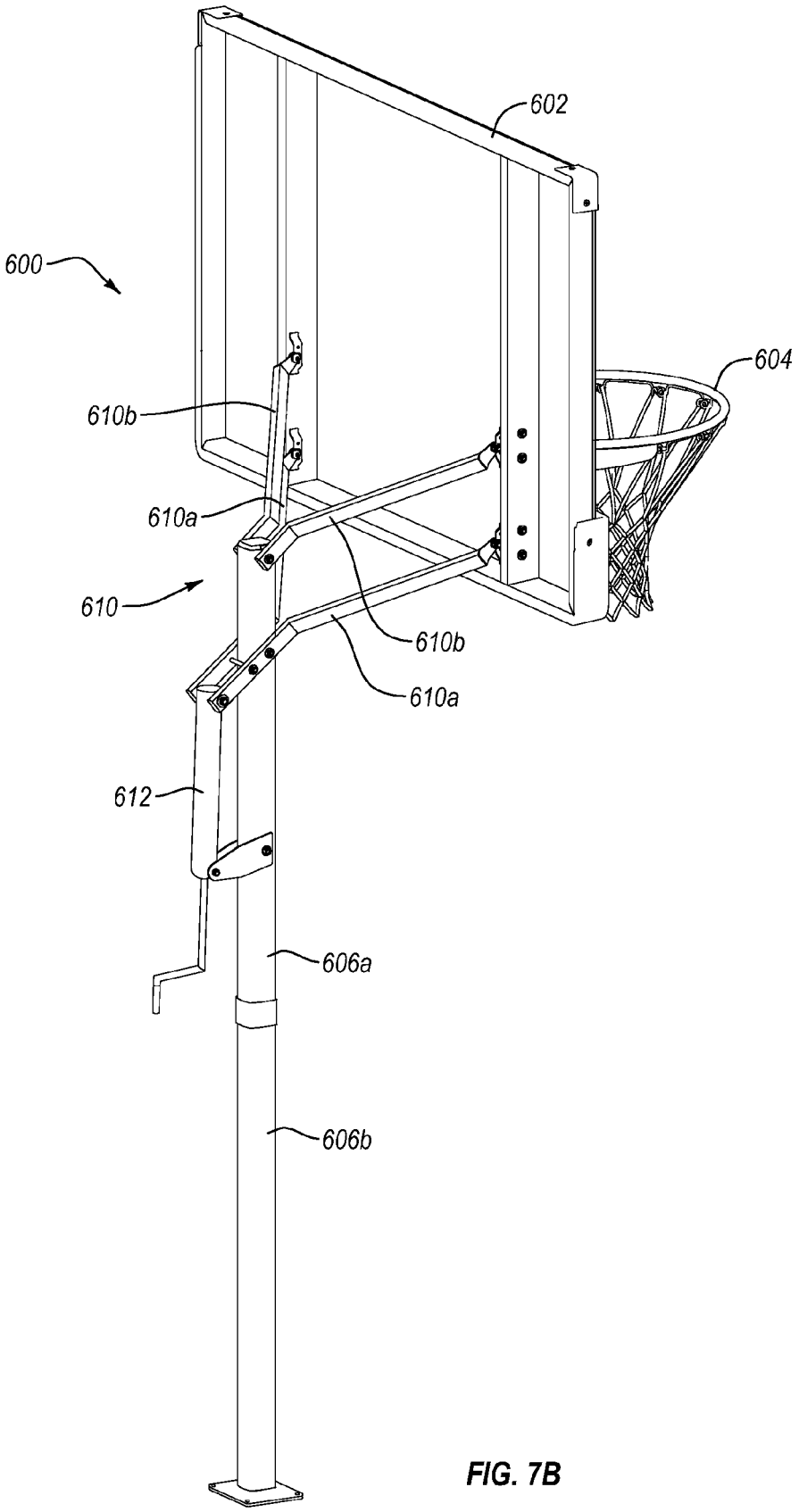

With the foregoing in view, attention is directed now to FIGS. 7*a* and 7*b* which disclose one example application for a joint such as is disclosed herein. In the particular illustrative example of FIGS. 7*a* and 7*b*, a basketball system denoted at 600 is provided. The basketball system 600 can be a portable basketball system, although that is note required and the basketball system 600 could, instead, be permanently anchored in the ground, or in pavement, concrete and/or other material(s).

The basketball system 600 includes a backboard assembly 602 which supports a goal 604. The backboard 602, in turn, is connected to a support pole 606 either directly, or indirectly by way of one or more intervening structures such as, but not limited to, clamps, brackets, arms. The support pole 606 is connected to a base 608 that may include one or more wheels or other mechanisms to enable the portability of the basketball system 600. As well, the basketball system 600 includes a connecting structure 610 that includes, in this example, a pair of upper arms 610*a* and a pair of lower arms 610*b*, all of which are rotatably connected to the support pole 606 and to a frame of the backboard assembly 602. A height adjustment mechanism 612 connected to the arms 610*a* enables a user to raise and lower the backboard 602 to a desired height. In the illustrated example, the height adjustment mechanism 612 takes the form of a screw mechanism that can be rotated by the user to change the height of the backboard 602.

The support pole 606 includes two or more pieces that fit together, such as segments 606*a* and 606*b* for example. The segments 606*a* and 606*b* of the support pole 606 thus collectively define a joint 650. The joint 650 can take the form of any of the joint embodiments disclosed herein, and the basketball system 600 may have one, or multiple, joints 650. As well, the segments 606*a* and 606*b* can take any of the forms of tubing or solid portions disclosed herein. In one particular embodiment, the segments 606*a* and 606*b* each take the form of square tube, although that particular form is not required.

In the example of FIGS. 7*a* and 7*b*, the joint 650 is configured such that the segment 606*a* is a flared portion, and the segment 606*b* is a swaged portion, although the opposite arrangement could alternatively be employed, that is, an arrangement where segment 606*a* is a swaged portion, and segment 606*b* is a flared portion. To assemble the joint 650, the user can simply insert the segment 606*b* into the segment 606*a* and move the segments 606*a* and 606*b* together until the segment 606*b* is fully received in the segment 606*a*. The segments 606*a* and 606*b* may also include fasteners (not shown) such as bolts or screws to hold the assembled joint 650 together, although that is not required.

As well, the segment 606*b* can include an indicator 606*c* that provides a visual cue to the user that the joint 650 is fully assembled, that is, the swaged portion of the segment 606*b* is fully received in the flared portion of the segment 606*a*. The indicator 606*c* may take, for example, the form of an inscribed and/or painted line or other marking which, when positioned near the bottom of segment 606*a* after the segment 606*b* has been inserted into segment 606*a*, indicates that the swaged portion of the segment 606*b* is fully received in the flared portion of the segment 606*a*.

F. Additional Example Embodiments

Figure 8A:
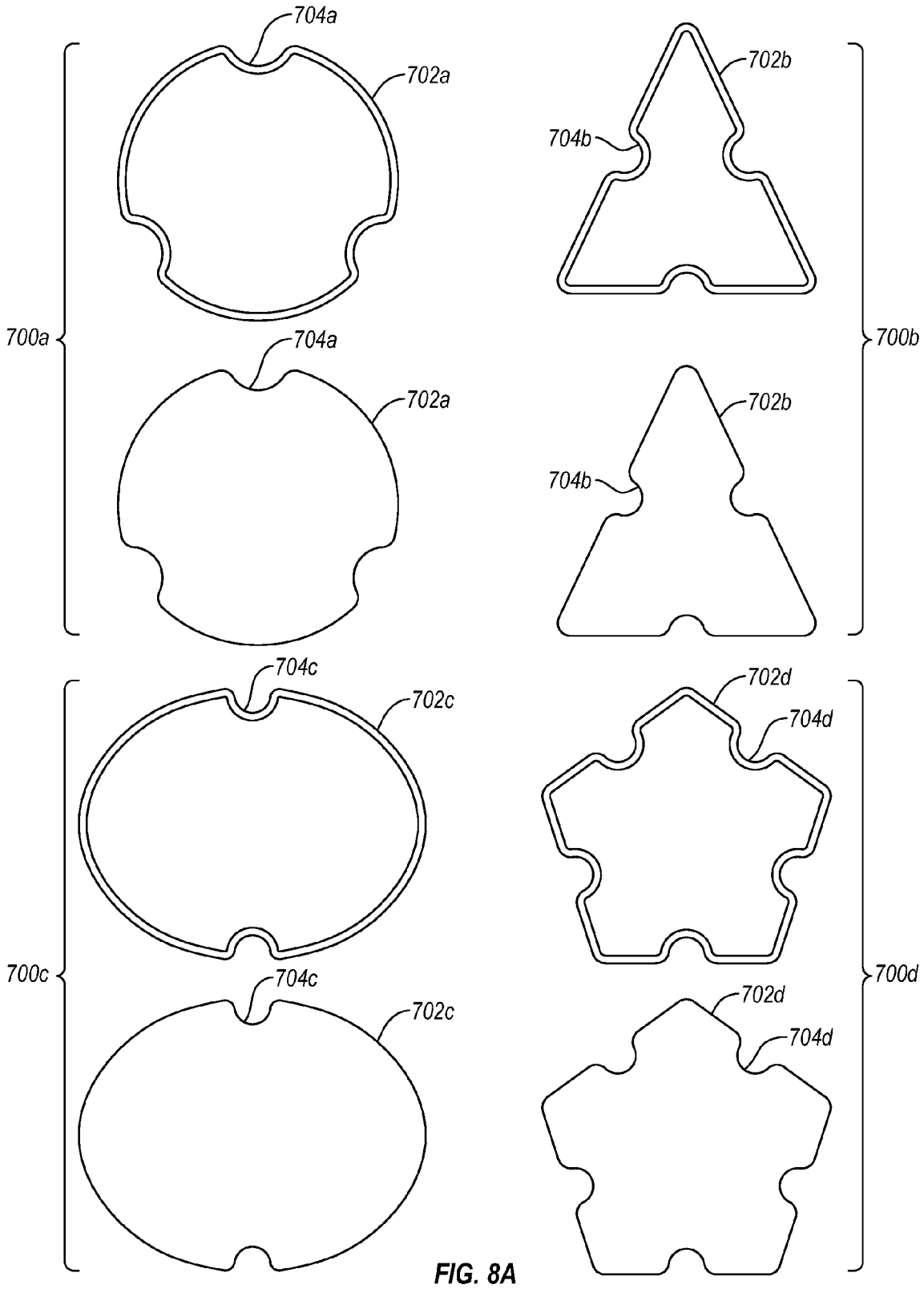
FIGS. 8*a* and 8*b* disclose various example embodiments of a swaged portion that may be employed in forming a joint.
Figure 8B:
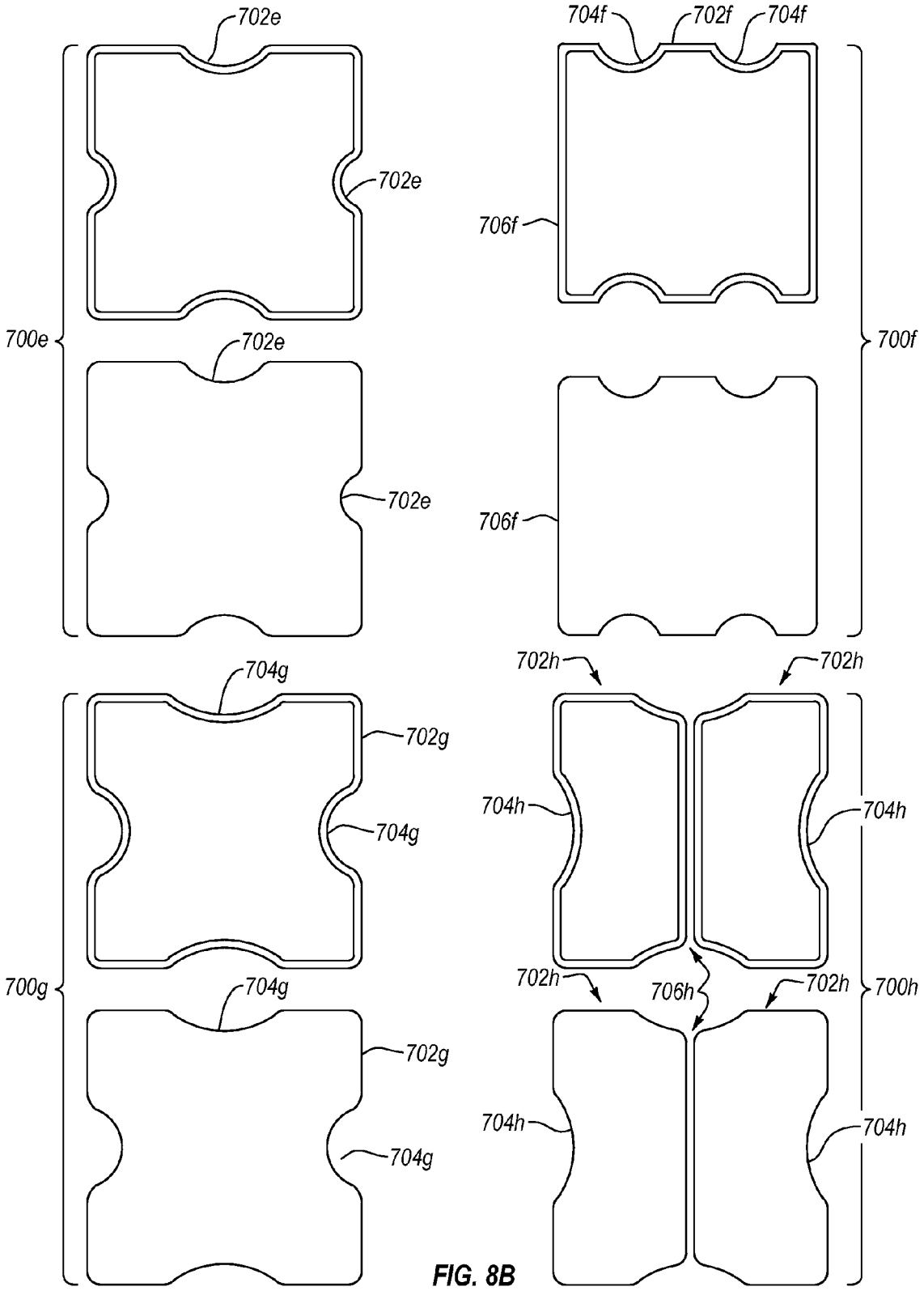

Turning now to FIGS. 8*a* and 8*b*, details are provided concerning some example swaged portions that may be employed in the formation of one or more joints. It should be noted that where multiple joints are employed in a particular application, the configuration of two or more of those joints may be substantially the same, or one of the joints may have a configuration that is different from a configuration of another of the joints. For example, two or more of the various different swaged portions disclosed in FIGS. 8*a* and 8*b* may be employed in a single application. It should also be understood that while FIGS. 8*a* and 8*b* disclose only swaged portions, the scope of the invention also embraces the respective flared portions that, while not specifically illustrated, correspond to the illustrated swaged portions of FIGS. 8*a* and 8*b*.

A variety of concepts will be apparent from the example swaged portions 700*a*-700*g* set forth in FIGS. 8*a* and 8*b*. The concepts disclosed in those Figures can be used together, in any combination, to define still further embodiments within the scope of the invention.

For example, and with reference first to swaged portions 700*a*, embodiments of the invention include swaged portions that have a single substantially continuous wall, such as wall 702*a* for example, rather than a set of walls that intersect with each other. Thus, the example swaged portions 700*a* are generally circular in their cross-section shape and, as shown, can be tubular or solid, and also include one or more local deformations 704*a*. The local deformations 704*a*, where more than one are present, can be evenly, or randomly, distributed about the circumference of the swaged portions 700*a*.

It should be noted that, in some circumstances at least, the use of one or more local deformations in embodiments that include a single substantially continuous wall may not provide as great an effect, in terms of contact between the swaged and flared portions, as the effect provided when one or more local deformities are employed in embodiments that include a plurality of discrete walls that intersect with each other. Nonetheless, embodiments of swaged portions that include a single substantially continuous wall with one or more local deformities may be beneficial in some applications.

As indicated by the swaged portions 700*b*, embodiments of the invention include swaged portions that include fewer than four walls. In the particular illustrated example, the swaged portions 700*b*, which can be in tubular or solid form, have a cross-section shape that is generally triangular and includes three walls 702*b*, any one or more of which can include one or more local deformations, such as local deformations 704*b*. The generally triangular cross-section shape can be any triangular shape, and is not limited to an equilateral triangle shape.

With continued reference to FIG. 8*a*, embodiments of the invention also include swaged portions that are not symmetric in one or more of their dimensions. In the particular illustrated example, the swaged portions 700*c*, which can be in solid or tubular form, have a cross-section shape that is oval, or elliptical. Similar to the example of swaged portions

700*a*, the wall 702*c* of the swaged portions 700*c* may be substantially continuous and uninterrupted by corners or other discontinuities, except for one or more local deformations 704*c*. Where a single local deformation 704*c* is provided, it can be located on the major, or minor, axis of the cross-section shape, although that local deformation 704*c* can be provided in any other location as well. In other embodiments, local deformations 704*c* can be provided on both the major and minor axes of the cross-section shape.

As indicated by the swaged portions 700*d* of FIG. 8*a*, embodiments of the invention also include swaged portions that include more than four walls. In the particular illustrated example, the swaged portions 700*d*, which can be in tubular or solid form, have a cross-section shape that is generally polygonal and includes five walls 702*d*, any one or more of which can include one or more local deformations, such as local deformations 704*d*.

Turning now to FIG. 8*b*, yet other concepts concerning swaged and flared portions are disclosed. As illustrated, swaged portions 700*e* include a plurality of local deformations 702*e*, at least two of which have different respective sizes. Of course, local deformations of different shapes, as well as sizes, can likewise be combined in a single embodiment.

As further indicated in FIG. 8*b*, swaged portions, such as swaged portions 700*f* for example, may be configured to include one or more walls 702*f* that include a plurality of local deformities 704*f* in a single wall. The swaged portion 700*f* may additionally, or alternatively, be configured with one or more walls that 706*f* include no local deformities.

At least some embodiments of the invention are directed to swaged portions, such as swaged portions 700*g*, that include one or more walls 702*g* having local deformities 704*g* of different shapes. Local deformities 704*g* of different respective shapes can be combined in a single wall 702*g*, or walls 702*g*. Additionally, or alternatively, and as indicated in FIG. 8*b*, two or more walls 702*g* may each have a respective local deformity 704*g* that has a different shape than a local deformity 704*g* present in one or more of the other walls 702*g*.

In still other embodiments of the invention, a swaged portion, such as swaged portion 700*h* for example, may include two or more discrete elements 702*h* that can be employed together as a single swaged portion 700*h*. The two or more discrete elements 702*h* may, or may not, be joined, permanently or releasably, together. For example, the discrete elements 702*h* may be releasably joined together by fasteners or respective mating structures included in each of the discrete elements 702*h*, or permanently joined together, such as by brazing or welding for example. In the illustrated example, the discrete element 702*h* each include respective local deformations 704*h* and/or cooperate to define still other local deformations 706*h*.

G. Example Embodiments of Dies

Figure 9:
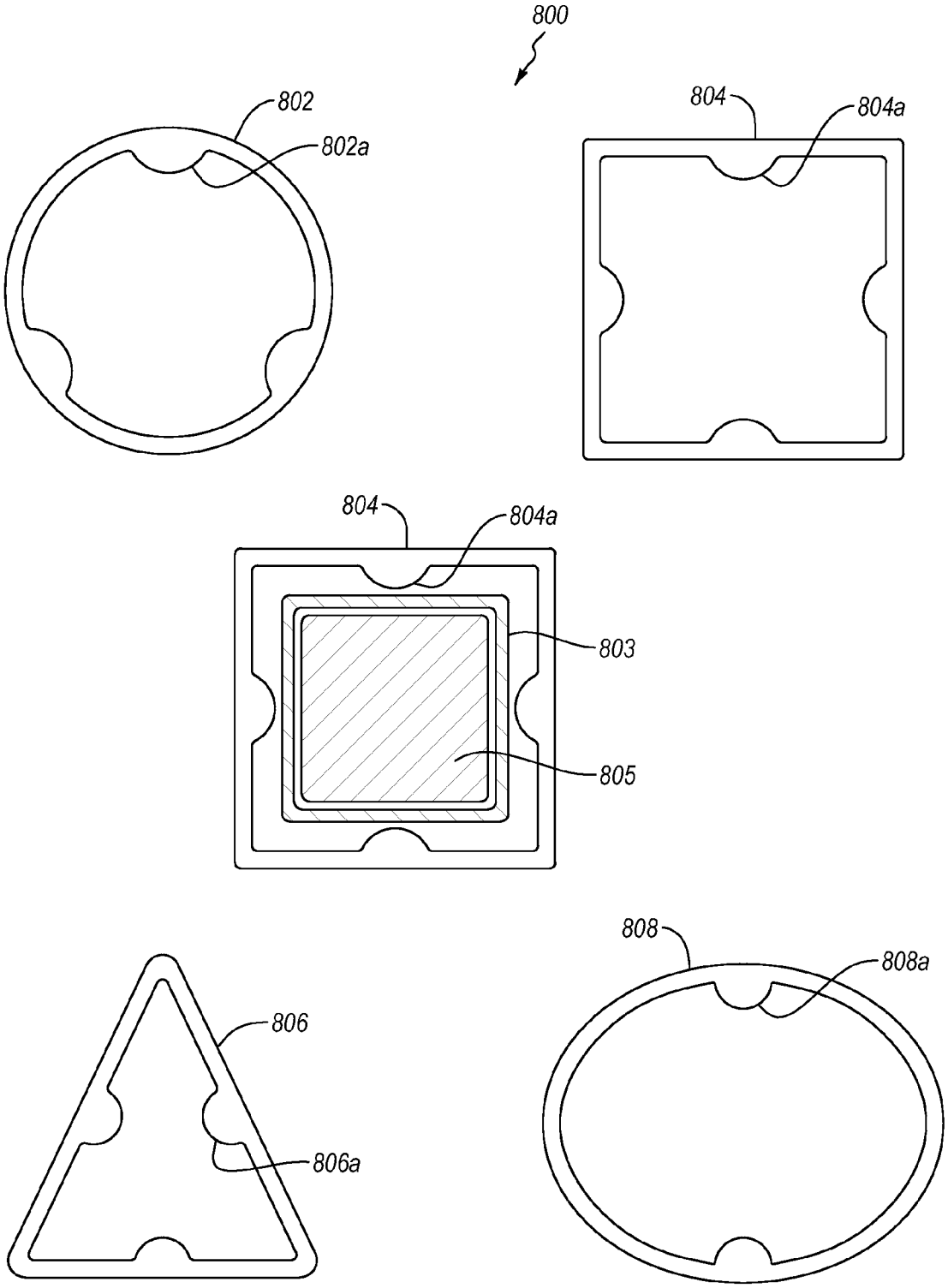
FIG. 9 discloses various example embodiments of dies that may be employed to form swaged portions such as those disclosed herein.

With attention now to FIG. 9, details are provided concerning some example dies 800 that may be used in the production of one or more of the swaged portions disclosed herein. The example dies 800 include a circular die 802, rectangular/square die 804, triangular die 806, and oval/elliptical die 806. In general, each of the dies 800 is substantially hollow and includes one or more protrusions 802*a*, 804*a*, 806*a* and 808*a*, respectively, that is configured and arranged to form a corresponding local deformity in an unswaged portion processed by the die. In general, the size, shape, configuration and orientation of the protrusion(s) mirror the size, shape, configuration and orientation of the local deformity(ies) desired to be produced.

While not specifically illustrated, dies may also be used to produce one or more of the flared portions disclosed herein. For example, a die in the shape of die 804 may be forced into a square tube to produce a flared portion in the square tube.

As disclosed herein, in at least some instances, a pair of dies, rather than just a single die, may be used to produce configurations such as those disclosed in FIGS. 4, 6, 8*a* and 8*b*. With continued attention to FIG. 9, aspects of one example arrangement of dies are disclosed. In particular, a workpiece 803, shown in an undeformed state, is provided that is at least partly disposed within the die 804. A second die 805 is positioned in the interior of the workpiece 803 and the second die 805 helps to ensure that the form or draw of the workpiece 803 is to the desired shape when the die 804 is forced onto the work piece 803. This multiple die process can also be used in any of the other embodiments disclosed herein.

In some instances, the die 805 can be omitted and the workpiece 803 can be shaped using only the die 804. This single die process can also be used in any of the other embodiments disclosed herein.

H. Example Production Methods

Figure 10:
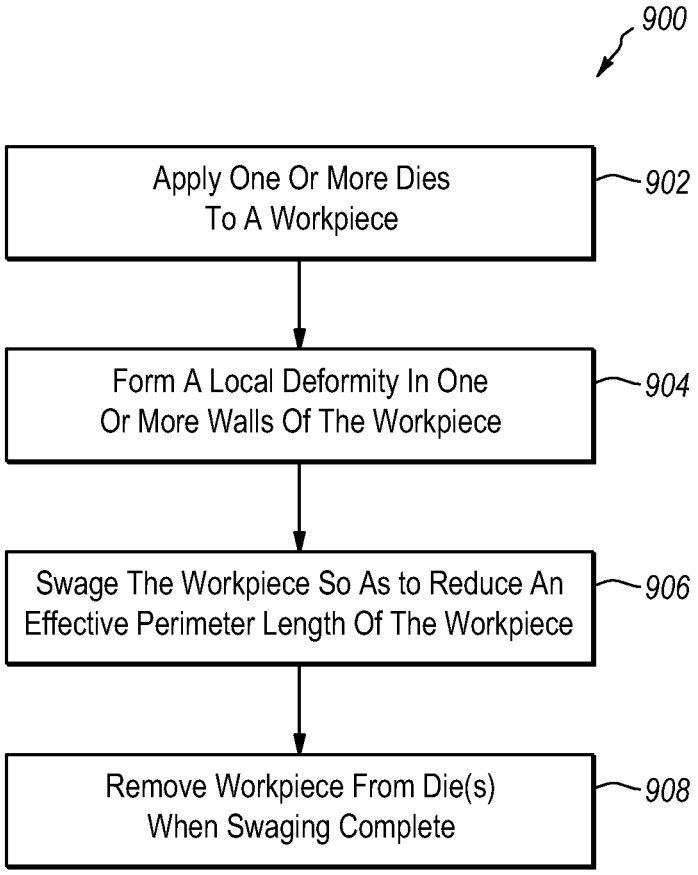
FIG. 10 discloses a method for producing a swaged portion.

Directing attention finally to FIG. 10, details are provided concerning an example method 900 for producing a swaged portion that includes one or more local deformities. This example method begins at 902 where one or more dies are applied to a workpiece, such as a piece of tubing or solid stock. Where multiple dies are employed, they may be applied sequentially, simultaneously, or in any other suitable manner.

At 904, one or more local deformities are formed in one or more walls of the workpiece as a result of application of the die, or dies. Such local deformities may include any of the example deformities disclosed herein. The method 900 then advances to 906 where the workpiece is swaged. In at least some embodiments, the swaging 906 reduces an effective perimeter size of the workpiece. It should be noted that 904 and 906 can be performed sequentially, or substantially simultaneously with each other.

After the workpiece has been swaged, and the desired local deformity, or deformities, formed in the workpiece, the workpiece can be removed 908 from engagement or contact with the die, or dies. Depending upon the dies used, and the configuration of the workpiece, some or all of the method 900 may be performed more than once on the workpiece.

I. Possible Advantages of One or More Embodiments

As will be apparent from the present disclosure, one or more embodiments of the invention may be advantageous in various regards. By way of illustration, one or more embodiments may enable more substantial contact between a swaged portion and mating flared portion through the use of one or more local deformities in one or more walls of the swaged portion. This substantial contact, in turn, may enable a more stable and stronger joint than would be obtained in configurations where such substantial contact is not achieved. Such stability can be particularly desirable in systems, such as basketball systems for example, that are subjected to repeated dynamic loading, and/or to static loading.

Although this disclosure has been described in terms of certain embodiments, other embodiments apparent to those of ordinary skill in the art are also within the scope of this disclosure. Accordingly, the scope of the disclosure is intended to be defined only by the claims which follow.

What is claimed is:

1. A basketball system, comprising:

a backboard;

a goal that is attachable to the backboard; and a support pole with which the backboard is connectable either directly or by way of one or more intervening structures, the support pole comprising:

a first pole segment that includes a swaged portion comprising:

four walls that cooperate to define a perimeter of the swaged portion, each of the walls being substantially straight and two of the walls terminating together at a common point such that an angle between the two walls of about 90 degrees is defined; and a respective local deformation defined in each of the four walls, wherein an attribute of one of the local deformations varies along a portion of a length of the swaged portion; and a second pole segment including a flared portion configured to receive the swaged portion of the first pole segment, wherein when the swaged portion is fully received in the flared portion, each of the walls of the first pole segment is in substantial contact with the flared portion of the second pole segment.

2. The basketball system as recited in claim 1, wherein the basketball system comprises a portable basketball system that includes a movable base to which the support pole is attachable.

3. The basketball system as recited in claim 1, wherein one or more of the local deformations includes a curved portion.

4. The basketball system as recited in claim 1, wherein one of the local deformations protrudes inwardly from an exterior surface of the swaged portion.

5. The basketball system as recited in claim 1, wherein except for the presence of the respective local deformation, each wall is substantially undeformed.

6. The basketball system as recited in claim 1, wherein one or more of the local deformations has a curved cross-sectional shape.

7. The basketball system as recited in claim 1, wherein one of the local deformations varies in its width and/or depth over its length.

8. The basketball system as recited in claim 1, wherein one of the local deformations varies gradually in its width and/or depth over its length.

9. The basketball system as recited in claim 1, wherein a width and/or depth of one of the local deformations tapers from an upper end of the local deformation to a lower end of that local deformation, the upper end being located proximate a terminal end of the swaged portion.

10. The basketball system as recited in claim 1, wherein all of the local deformations have substantially the same size, configuration, and orientation.

11. The basketball system as recited in claim 1, wherein the first pole segment is made of metal.

12. The basketball system as recited in claim 1, wherein each wall has two straight portions, one on either side of the local deformation in that wall.

* * * * *